US005827009A

United States Patent [19]

Kokoletsos

[11] Patent Number: 5,827,009

[45] Date of Patent: Oct. 27, 1998

[54] TACTILE WARNING SURFACE, METHOD, AND APPARATUS

[76] Inventor: Basil George Kokoletsos, P.O. Box 201, Ridgewood, N.J. 07451-0201

[21] Appl. No.: 579,808

[22] Filed: Dec. 28, 1995

[51] Int. Cl.[6] ..... E01C 15/00; E01C 19/50

[52] U.S. Cl. ..... 404/75; 249/2; 404/15; 404/108; 404/82

[58] Field of Search ..... 404/15, 17, 18, 404/9, 93, 94, 75, 82, 101, 108; D25/157, 163; 116/205; 434/112; 264/33, 241, 250, 251; 249/2

[56] References Cited

U.S. PATENT DOCUMENTS

| | | | |
|---|---|---|---|
| 4,349,588 | 9/1982 | Schiffer | 427/230 |
| 4,715,743 | 12/1987 | Schmanski | 404/9 |
| 4,932,182 | 6/1990 | Thomasson | 404/18 X |
| 5,217,319 | 6/1993 | Klohn | 404/15 |
| 5,302,049 | 4/1994 | Schmanski | 404/42 |
| 5,320,790 | 6/1994 | Lowe | 264/31 |
| 5,487,526 | 1/1996 | Hupp | 264/250 X |

*Primary Examiner*—James Lisehora

*Attorney, Agent, or Firm*—Evelyn M. Sommer

[57] ABSTRACT

A tactile warning surface has an array of tactile elements made of a composite material formed on the surface of an existing substrate. The preferred composite material is a mixture of a dry powder aggregate and a liquid SBR latex. The tactile elements are in the form of truncated cones or flattened domes having a height of about 0.20 inch and a diameter of about 1.0 inch. A method for installing the tactile warning surface includes the steps of placing a mold sheet having an array of mold apertures with shapes corresponding to the tactile elements over the substrate area, injecting the composite material in a semi-liquid state under pressure into the apertures of the mold sheet, allowing the injected composite material to cure and harden, then removing the mold sheet. For increased durability in traffic-bearing applications, a pigment/aggregate mixture can be applied as a coating over the tactile elements and substrate area. The tactile warning surface is installed using an injecting machine having a hopper for receiving the composite material and an access slot below for releasing it into the mold apertures of the mold sheet. The machine can also include a vibrator and arm extending into the hopper for vibrating the semi-liquid composite material.

3 Claims, 4 Drawing Sheets

TACTILE WARNING SURFACE, METHOD, AND APPARATUS

FIELD OF THE INVENTION

This invention generally relates to a tactile warning surface of high durability, particularly for walking surfaces, and a method and apparatus for producing it quickly and conveniently.

BACKGROUND ART

Tactile warning surfaces are required to be installed in public places in accordance with laws and governmental guidelines designed to promote the safety of persons with disabilities. Particularly, walking surfaces providing tactile warnings are required for public safety adjacent to hazardous and vehicular areas, curb ramps, edges of transit platforms, and edges of pools and fountains. Such warning surfaces provide a physical indication to blind persons, and even to sighted persons who may not be paying attention, of an area that is near hazards and potential dangers.

Prior tactile warning surfaces have taken the form of tiles or matting that are installed on walkways and access areas. However, such surface coverings have low durability over a long service life and with intensive use, and can present a raised elevation over the existing substrate which may be a hazard to pedestrians. Other approaches to installing more durable tactile warning surfaces within the confines of existing elevations have included cutting into existing pavement and pouring new concrete sections, or scarification of existing pavement with grooves and other tactile forms. These approaches have the problems of being labor-intensive, requiring the cordoning off of large work areas, and generating large amounts of dust and noise.

SUMMARY OF THE INVENTION

It is therefore a principal object of the invention to provide a tactile warning surface, method, and apparatus for producing it which results in a permanent installation of high durability and can be installed quickly and conveniently. It is a specific object that this system requires no cutting or scarification of the substrate to maintain existing elevations.

In accordance with the present invention, a tactile warning surface comprises an array of tactile elements made of a composite material and formed on the surface of an existing substrate, wherein said tactile elements have a low height and a relatively close spacing to one another so as to provide a tactile warning function, and wherein said composite material comprises a mixture of mortar and a latex material. Preferably, the tactile elements are in the form of truncated cones or flattened domes having a low height in the range of about 0.20 inch and a diameter in the range of about 1.0 inch.

As a further aspect of the invention, a method for installing a tactile warning surface on an existing substrate comprises the steps of: (a) placing a mold sheet of a given thickness over an area of the substrate on which the tactile warning surface is to be installed, said mold sheet having an array of mold apertures formed therein which extend through the thickness of the mold sheet and have a shape corresponding to tactile elements to be injected and cured therein; (b) injecting a composite material in a semi-liquid state under pressure into the apertures of the mold sheet so as to fill the apertures from the substrate surface up to the thickness of the mold sheet; (c) allowing the injected composite material to cure and harden within the mold apertures on the substrate surface; and (d) peeling the mold sheet away from the tactile elements hardened on the substrate surface. For increased durability in traffic-bearing applications, a coating made of a mixture of liquid pigmented latex and a powder aggregate is applied over the tactile elements and substrate area.

As yet a further aspect of the invention, an apparatus for installing a tactile warning surface on an existing substrate comprises a mold sheet of a given thickness to be placed over an area of the substrate on which the tactile warning surface is to be installed, said mold sheet having an array of mold apertures formed therein which extend through the thickness of the mold sheet and have a shape corresponding to tactile elements to be injected and cured therein, and injecting means for injecting a composite material in a semi-liquid state under pressure into the apertures of the mold sheet so as to fill the apertures from the substrate surface up to the thickness of the mold sheet. In the preferred embodiment, the injecting means is a machine having means for moving it over an upper surface of the mold sheet, and a hopper having walls forming an upright volume for receiving a quantity of composite material in semi-liquid state therein and an access slot at a lowermost portion thereof for releasing semi-liquid composite material below into the mold apertures in the mold sheet, wherein said hopper is arranged in said machine so that its access slot is positioned to be in moving contact with the surface of the mold sheet. The injecting machine can include a pull handle at a front side of the machine, a vibrator and arm extending into the hopper for vibrating the semi-liquid composite material so that it moves down evenly through the access slot, and a counterweight positioned at a rear side of the machine for weighting the machine and hopper access slot down against the surface of the mold sheet.

Other objects, features, and advantages of the present invention will become apparent from the following detailed description of the best mode of practising the invention having reference to the following drawings:

DESCRIPTION OF THE PREFERRED EMBODIMENTS

Figure 1:
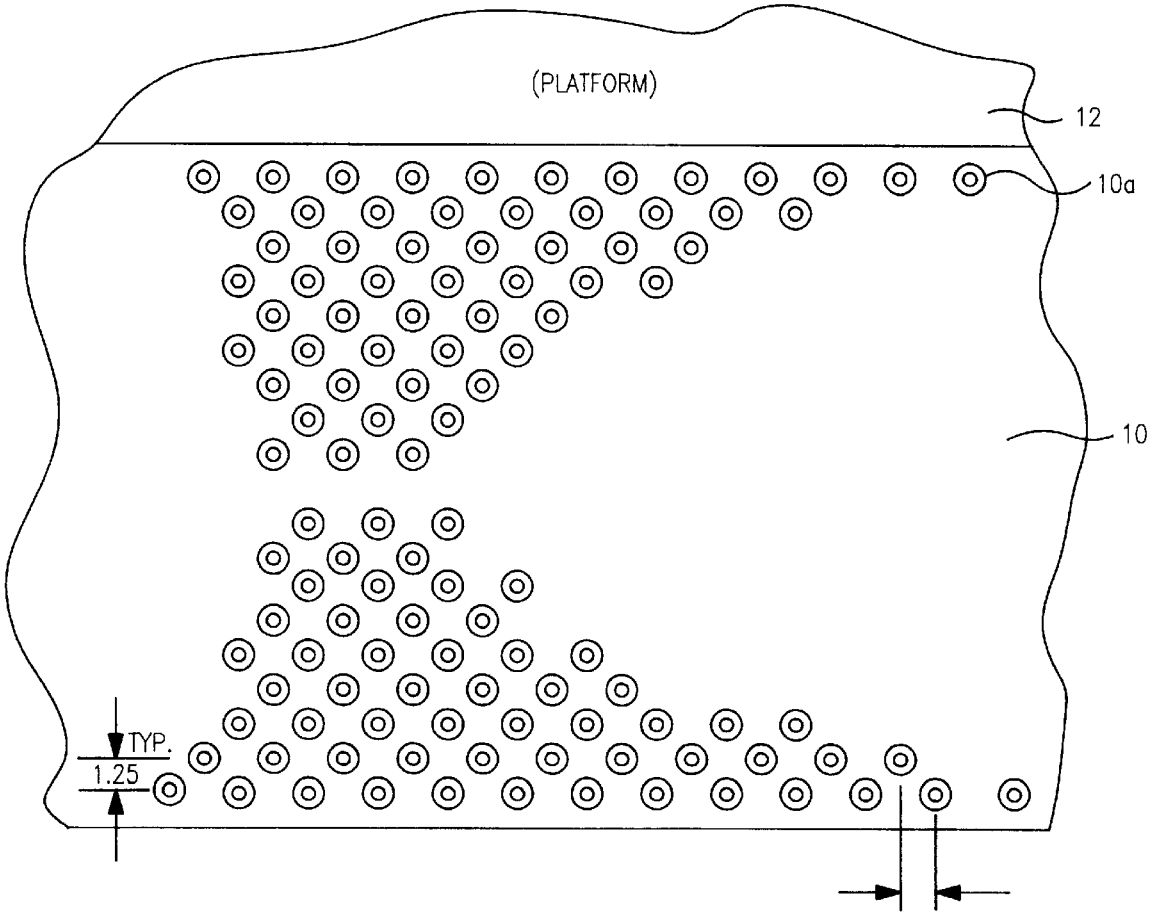
FIG. 1 is an illustration of a tactile warning surface installed on a platform in accordance with the invention.
Figure 3:
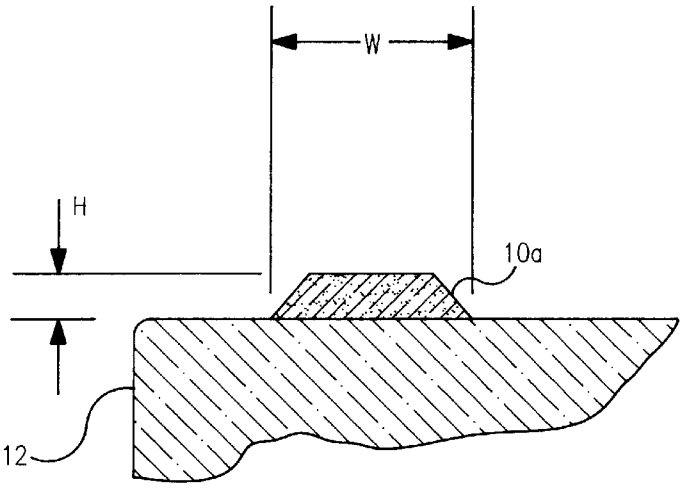
FIG. 3 is a side sectional view of a tactile element.
Figure 2:
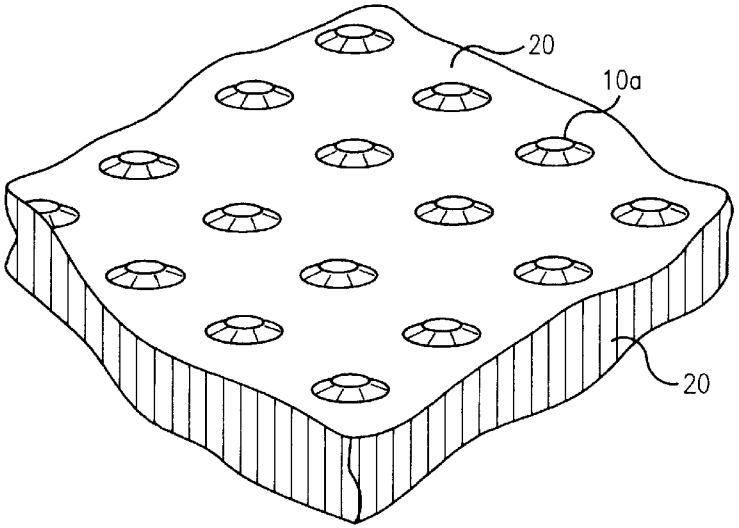
FIG. 2 is a close-up perspective view of a section of the tactile warning surface.

In FIG. 1, an example of a tactile warning surface 10 is shown installed on a platform 20 in accordance with the present invention. The tactile warning surface 10 consists of an array of tactile elements 10*a* installed on the surface of the platform. FIG. 2 shows a close-up view of a section of the tactile warning surface, and FIG. 3 shows a side view of the tactile element which is used in the array. The tactile elements 10*a* preferably have a truncated cone or flattened dome shape of a suitable width W and a low height H above the existing elevation of the platform. The upper surface of each element is flat or may have a slight concavity which occurs due to shrinkage after the material for the elements is poured and allowed to cure. In the preferred embodiment, the tactile elements 10*a* have a width of about 1.0 inch, and a height of about 0.20 inch which is low enough so as not to present a hazard to pedestrians.

The tactile elements are made of a composite material which is injected in a semi-liquid state through a mold onto the surface of an existing substrate and allowed to harden thereon. The tactile elements are preferably installed offset from each other from row to row with a relatively close spacing of about 2.35 inches between elements in a row and 1.25 inches on centers to the proximate elements offset in the adjacent rows. The close spacing and offset arrangement are chosen to avoid catching the wheels of strollers and wheelchairs or the edges of the shoes of pedestrians.

The composite material of the tactile elements is a mixture of mortar and a latex material. A particularly suitable composite is formed by mixing together a carboxylated SBR (styrene butadiene resin) latex, such as #82 Liquid™ sold by Strongwall Industries, Inc., of Ridgewood, N.J., and a dry powder aggregate, such as a blend of portland cement and crystalline quartz sold under the name #82 Powder™ also from Strongwall Industries.

For increased durability in traffic-bearing applications, a pigment and aggregate mixture can be applied as a coating over the tactile elements and substrate area. A preferred pigment/aggregate mixture is formed with a blend of SBR latex and vinyl, such as #32 Liquid™, and a catalyst powder aggregate of portland cement and crystalline quartz sold under the name #32 Powder™, both of which are commercially available from Strongwall Industries, Inc.

Figure 4:
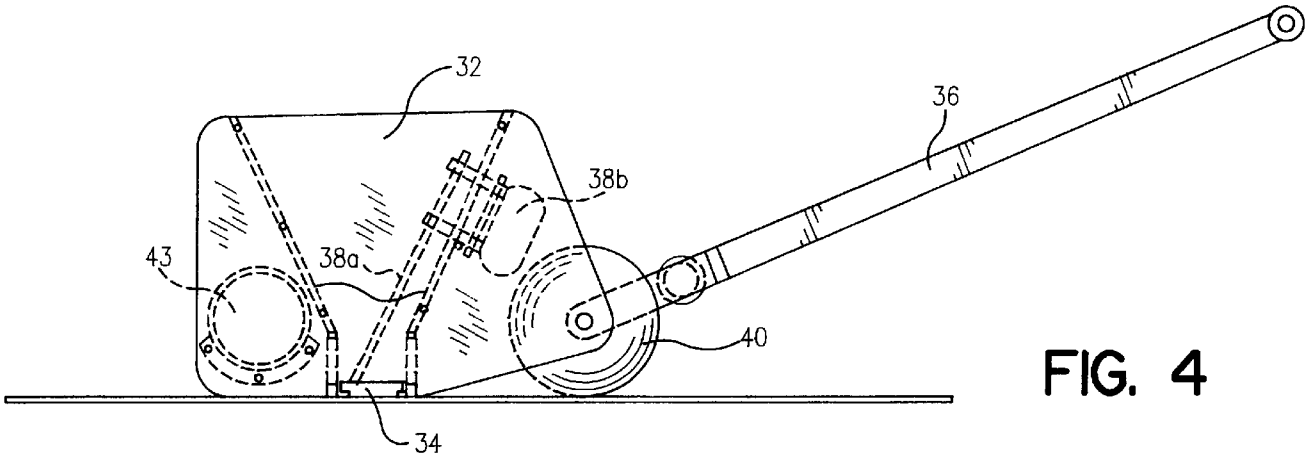
FIG. 4 is a side sectional view of an apparatus for installing a tactile warning surface in accordance with the invention.
Figure 5:
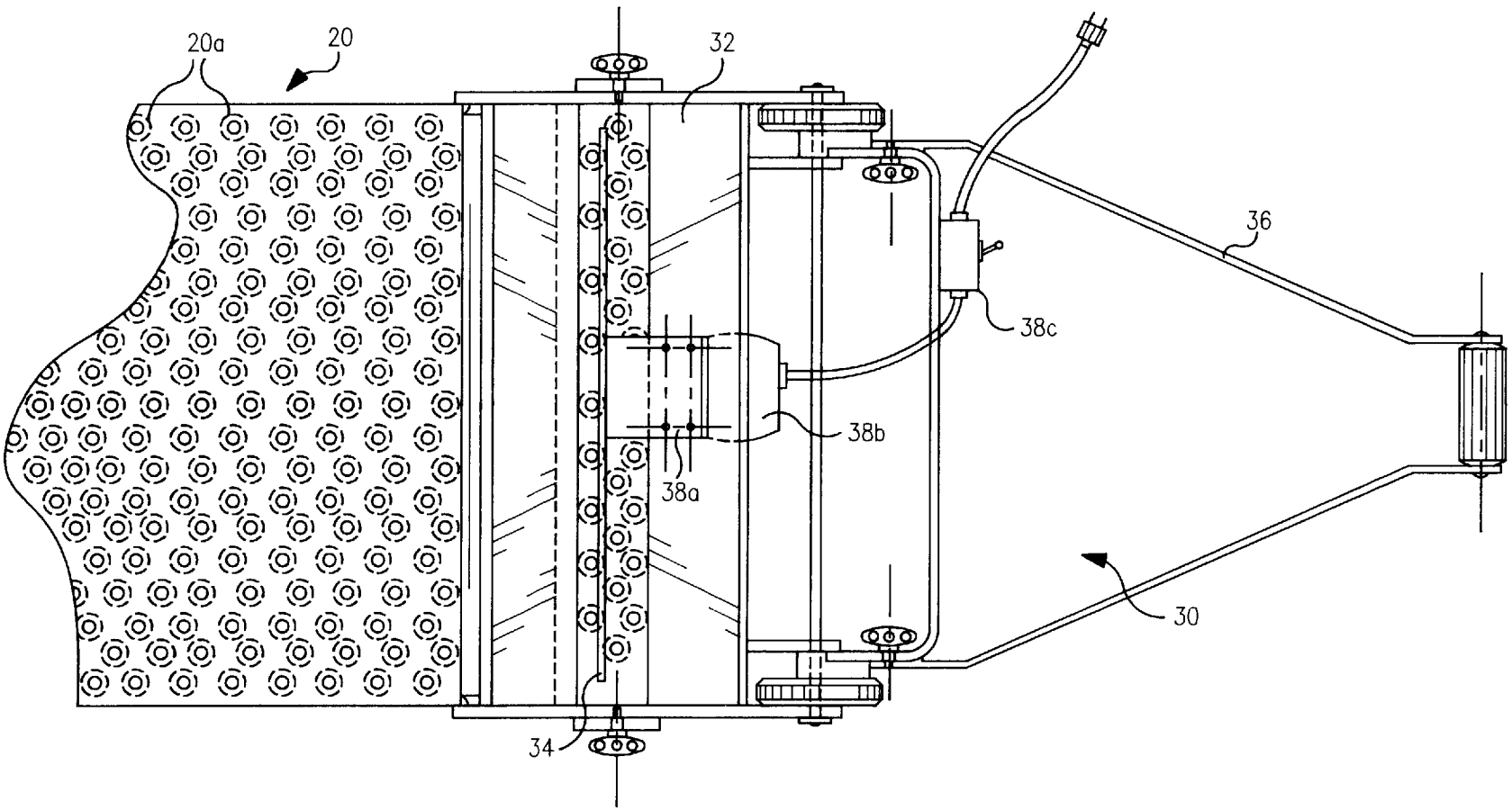
FIG. 5 is a plan sectional view of the installing apparatus.
Figure 6:
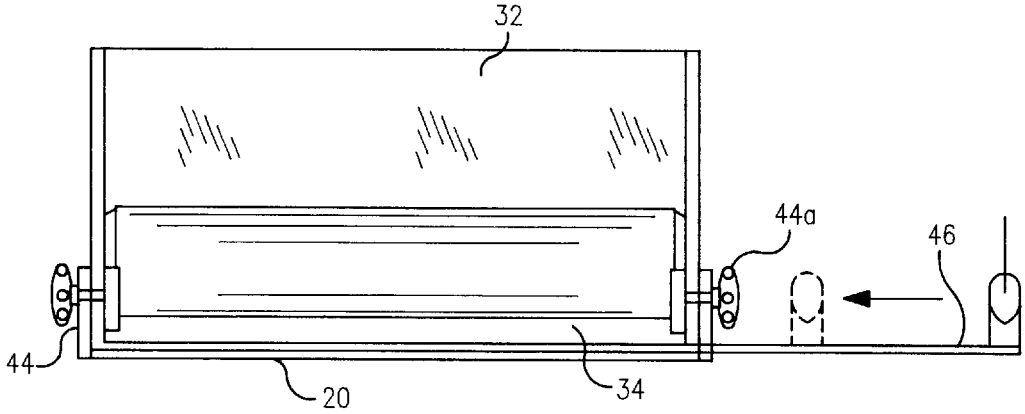
FIG. 6 is a front sectional view of the installing apparatus.

In FIGS. 4, 5, and 6, an apparatus for installing the tactile elements includes a mold sheet 20 having an array of mold apertures 20*a* formed therein which extend through the thickness of the mold sheet. The apertures have a truncated cone or flattened dome shape corresponding to the tactile elements to be extruded into and cured therein. The thickness of the mold sheet corresponds to the intended height of the tactile elements. The mold sheet is made of a flexible non-reactive material such as rubber to facilitate laying it down and peeling it up from the substrate surface and rolling it up for storage.

An injecting machine 30 is used to inject the composite material in a semi-liquid state under pressure into the apertures of the mold sheet so as to fill the apertures from the substrate surface up to the thickness of the mold sheet. The injecting machine 30 has a hopper 32 with walls forming having an upright volume for receiving a quantity of composite material in semi-liquid state therein and an access slot 34 at a lowermost portion thereof for releasing the semi-liquid composite material below into the mold apertures in the mold sheet. The access slot 34 is positioned to be moved in contact with the surface of the mold sheet.

In the preferred design, a pull handle 36 is arranged at a front side of the machine for pulling it over the surface of the mold sheet. A vibrator arm 38*a* extends depthwise into the hopper and is coupled to a vibrator motor 38*b*, which is supplied with power through a switch unit 38*c*, for moving the semi-liquid composite material evenly down to the access slot 34. Wheels 40 are provided at the front of the machine, and a counterweight 42 is positioned at a rear side of the machine for weighting the machine and hopper access slot 34 down against the surface of the mold sheet. The hopper has a width extending across the width of the mold sheet 20. Movable mold guides 44 can also be provided along the outside of each side wall of the hopper. In the down position (44), the mold guides 44 project below the bottom of the hopper and abut with the side thickness of the mold sheet for allowing the machine to be smoothly tracked over the length of the mold sheet. In the up position indicated as 44*a*, the mold guide on at least one side is cleared from the bottom of the hopper so that a shut off gate 46 can be inserted sideways (in the direction of the arrow in FIG. 6) to close the access slot and hold back the composite material when the material injecting step has been completed.

A preferred installation procedure is described below for the installation of tactile elements on a concrete substrate, which is typical of sidewalks, outdoor ramps and stairs, and transit platforms. The surface of the substrate is cleaned to remove dirt, grease, etc., such as by water blasting. The concrete substrate is dampened to a dull gray, without any standing water. The mold sheet or sheets are placed on the work area to form the desired array. Typical mold sheets are 1 foot wide and 6 feet long, and can be combined in any pattern desired for the tactile element array. The mold array may be outlined with duct tape along its outer edges. The composite material is prepared by gradually adding the dry aggregate powder to the SBR latex liquid while stirring to form a lump-free mix of the desired consistency for good material flow into the mold cavities. A preferred mixing ratio is 5.5 quarts of #82 Liquid™ latex for each 65-pound bag of #82 Powder™ mortar.

The semi-liquid composite material is then poured into the hopper of the injecting machine, and the machine is positioned at a beginning end of the mold sheet with the mold guides in the down position for tracking. The injecting machine, with the vibrator unit turned on, is pulled over the length of the mold sheet while the composite material flows through the access slot to fill into the mold cavities. The side walls of the access slot press the material into the mold cavities while also scraping the surface of the mold sheet clear of excess material. When all the mold cavities have been filled, the shut off gate is inserted to close the access slot of the injecting machine.

The injected composite material is then allowed to cure and harden in the mold cavities. Typical curing times are about 3 hours in ambient temperatures of 45° to 55° F., 2 hours in 55° to 70° F., and 1 hour over 70° F. When the composite material has hardened, the mold sheet can be peeled away from the tactile elements hardened on the substrate surface.

The pigment/powder material for the coating over the tactile elements is prepared by mixing the #32 Liquid™ pigmented latex blend with #32 Powder™ aggregate until the mixture is lump free. A preferred mixing ratio is 2.5 gallons of #32 Liquid™ for each 55-pound bag of #32 Powder™ to cover approximately 200 square feet of array and substrate area. The pigment mixture can be applied by pouring a small amount evenly over the tactile element array and spreading it smoothly with a long nap roller, taking care to remove excess material from around the bases of the elements. This coating provides a high pigmented color and a durable surface on the array. If desired, a coating of sealer material can be applied over the tactile elements for a smooth, brighter finish.

The tactile warning surface, method, and apparatus of the invention thus allows the elements to be installed quickly and conveniently on an existing elevation of the substrate without the need to cut or scar into the substrate. The resulting tactile warning surface has shown high wear, impact, and weathering resistances, as well as good compressive, tensile, and bonding strengths Numerous modifications and variations are of course possible in light of the principles of the invention disclosed above. For example, all such modifications and variations are intended to be included within the spirit and scope of the invention, as defined in the following claims.

I claim:

1. A method for installing a tactile warning surface on an existing substrate comprising the steps of:

(a) placing a mold sheet of a given thickness over an area of a substrate on which the tactile warning surface is to be installed, said mold sheet having an array of mold apertures formed therein which extend through the thickness of the mold sheet and have a shape corresponding to tactile elements to be injected and cured therein;

(b) injecting a composite material in a semi-liquid state under pressure into the apertures of the mold sheet so as to fill the apertures from the substrate surface up to the thickness of the mold sheet;

(c) allowing the injected composite material to cure and harden within the mold apertures on the substrate surface; and (d) peeling the mold sheet away from the tactile elements hardened on the substrate surface wherein said injecting step is performed using an injecting machine having a hopper with walls forming an upright volume for receiving the semi-liquid composite material therein and an access slot at a lowermost portion thereof for releasing semi-liquid composite material below into the mold apertures in the mold sheet.

2. A method for installing a tactile warning surface according to claim 1, wherein said hopper is arranged in the injecting machine so that its access slot is positioned to be in moving contact with the surface of the mold sheet.

3. A method for installing a tactile warning surface according to claim 1, comprising the step of applying a coating made of a mixture of a liquidated pigmented latex and a powder aggregate over the tactile elements and substrate area for increased durability in traffic-bearing applications wherein said coating step is performed by pouring a small amount of the pigment/powder mixture evenly over the tactile element array and spreading it smoothly with a long nap roller.

* * * * *